United States Patent [19]

Schulz

[11] Patent Number: 5,013,250

[45] Date of Patent: May 7, 1991

[54] MULTI-POLE CONNECTOR PLUG

[75] Inventor: Erhard Schulz, Nuremberg, Fed. Rep. of Germany

[73] Assignee: Fritz Hartmann Gerätebau GmbH & Co. KG, Baiersdorf, Fed. Rep. of Germany

[21] Appl. No.: 450,001

[22] Filed: Dec. 15, 1989

[30] Foreign Application Priority Data

Dec. 23, 1988 [DE] Fed. Rep. of Germany ... 8815974[U]

[51] Int. Cl.[5] ..... H01R 23/70

[52] U.S. Cl. ..... 439/79; 361/395; 439/74

[58] Field of Search ..... 439/79, 80, 55, 59, 439/76, 74, 75; 361/395, 399, 412, 413

[56] References Cited

U.S. PATENT DOCUMENTS

| | | | |
|---|---|---|---|
| 1,853,173 | 4/1932 | Okun | 439/680 |
| 3,147,402 | 9/1964 | Hochstetler | 324/158 F |
| 3,864,000 | 2/1975 | Coller et al. | 439/246 |
| 4,454,566 | 6/1984 | Coyne | 361/415 |
| 4,568,136 | 2/1986 | Reuss | 439/83 |
| 4,723,196 | 2/1988 | Hofmeister | 361/399 |

*Primary Examiner*—Neil Abrams

*Attorney, Agent, or Firm*—Spencer & Frank

[57] ABSTRACT

A multi-pole plug-in connector, particularly for the connection of printed circuit boards with cables, has a connector including an insulating strip (1) and a plurality of juxtaposedly fixed contact pins (3) arranged in mutually parallel planes (2). A female connector can be plugged onto the plug-in arms (4) projecting from the one side of the insulating strip (1). The printed circuit board arms (6', 6'') projecting from the other side of the insulating strip (1) extend in at least two different directions so that the plug-in connector can be simultaneously connected with at least two printed circuit boards.

10 Claims, 2 Drawing Sheets

FIG.1
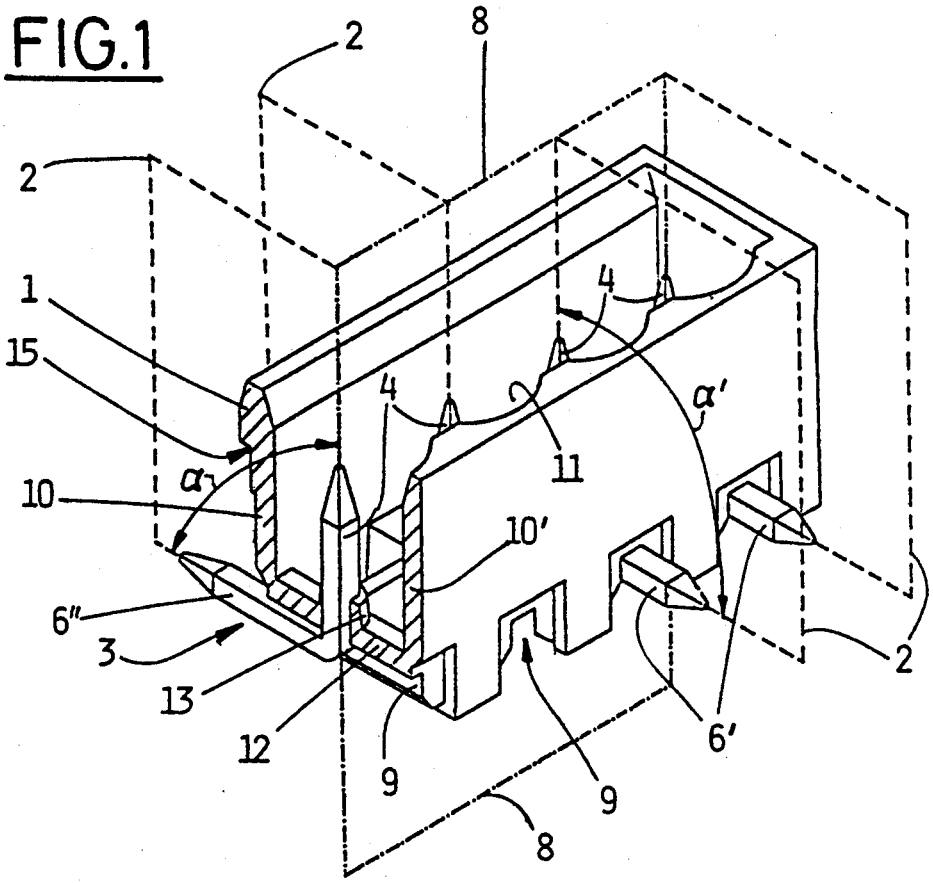
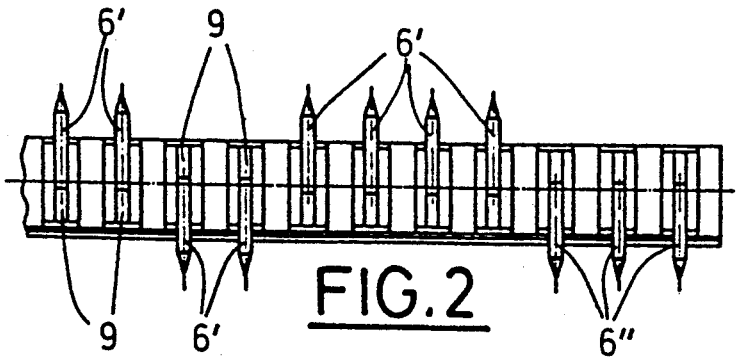
FIG.2
FIG.3
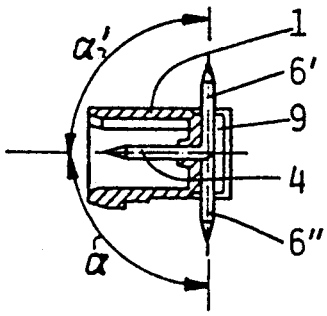
FIG.4
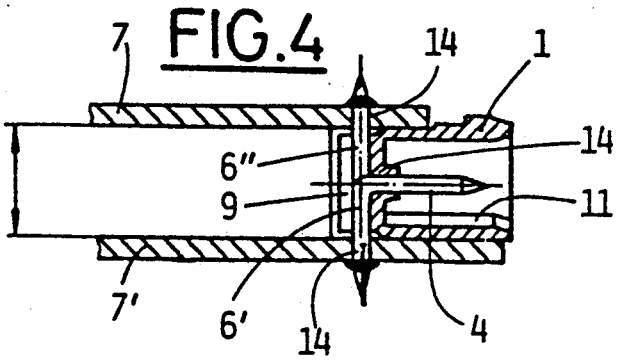
FIG.5
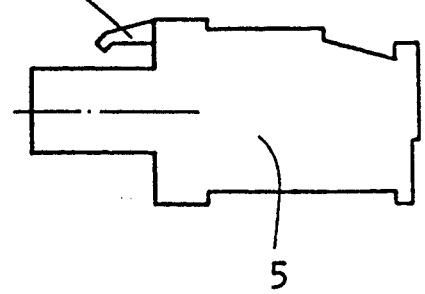

MULTI-POLE CONNECTOR PLUG

BACKGROUND OF THE INVENTION

1. Field of the Invention

The invention relates to a multi-pole plug-in connector.

2. Background Art

Plug-in connectors of the above-mentioned type—in practice often also called multi-point connectors—serve, inter alia, to electrically and mechanically connect printed circuit boards with cables. The connection is made by contact pins which are fixed in an insulating strip and have their one arms, the printed circuit board arms, which project in a row from one side of the strip, inserted into and possibly soldered to corresponding rows of holes in the printed circuit boards. The other arms, the plug-in arms, also projecting in a row from the other side, can be attached to a female connector which leads to the cable.

Depending on type, the printed circuit board arms either all extend in linear extension of the plug-in arms or they are bent at approximately right angles to the plug-in arms. In the former case, the plug-in arms and thus the direction in which the female connector is attached, is parallel to and, in the latter case, at a right angle to the surface of the printed circuit board.

The embodiment with angled printed circuit board arms and thus an attachment direction parallel to the surface of the printed circuit board is used primarily if several printed circuit boards are to be accommodated in the most space saving manner, for example in a housing. As the prior art plug-in connectors can each be connected with only one circuit board, a number n of printed circuit boards also requires n plug-in connectors to be accommodated in the available space.

SUMMARY OF THE INVENTION

Based on these facts, it is an object of the invention to develop a plug-in connector which can simultaneously be connected with two mutually parallel printed circuit boards and with a female connector for the cable input.

This is accomplished by a multi-pole plug-in connector having an insulating strip, and a plurality of contact pins attached to the insulating strip and disposed in substantially mutually parallel planes. The contact pins include: (1) a plurality of plug-in arms extending in a first direction and being connectable to female connectors; (2) a first plurality of printed circuit board arms extending in a second direction and being electrically and mechanically connectable with a first printed circuit board; and (3) a second plurality of printed circuit board arms extending in a third direction and being electrically and mechanically connectable with a second printed circuit board. The third direction is at an angle to said second direction. With such a connector, the printed circuit board arms of the contact pins are oriented in two different directions and can therefore be connected with two printed circuit boards.

In another preferred embodiment of the invention, there are angled circuit board arms. This embodiment makes it possible to connect two printed circuit boards with the plug-in connector in such a way that the printed circuit boards extend parallel to one another and parallel to the plug-in arms. The minimum distance between the two printed circuit boards is limited by the width of the plug-in connector. The packing density of several such pairs of circuit boards connected by means of a plug-in connector is now considerably reduced because, for a number of n printed circuit boards, only a number of n/2 (n=even number) or (n+1)/2 (n=odd number) plug-in connectors are required.

The manufacturing technology expenditures for the plug-in connector according to the invention is practically the same as for the prior art plug-in connector whose printed circuit board arms are oriented in only one direction as its contact pins are inserted as before into the holes of the prefabricated insulating strip and are then bent over toward the one or the other side according to any desired scheme.

A still further embodiment of the invention makes it possible to connect two printed circuit boards that are arranged at a right angle to one another by means of one plug-in connector.

The root regions of the angled printed circuit board arms of this embodiment rest in grooves defined in the side of an insulating strip and are thus protected against inadvertent bridging upon contact with electrically conductive objects and are fixed in their positions.

In still further embodiments U-shaped cross-sectional profiles and recesses in the interior of one side wall of the U-shaped profile serve as insertion aids and serve to prevent incorrect insertion of the female connector.

The invention will now be described in greater detail with reference to embodiments thereof that are illustrated in the drawing figures. It is shown in:

BRIEF DESCRIPTION OF THE DRAWINGS

FIG. 1, a perspective sectional view of a preferred embodiment of the plug-in connector;

FIG. 2, a top view of the underside of the plug-in connector of FIG. 1;

FIG. 3, a sectional view of the plug-in connector of FIG. 1;

FIG. 4, a sectional view of the plug-in connector of FIG. 1 connected with two printed circuit boards;

FIG. 5, a schematic drawing of a female connector;

DETAILED DESCRIPTION OF THE PREFERRED EMBODIMENTS

Figure 6:
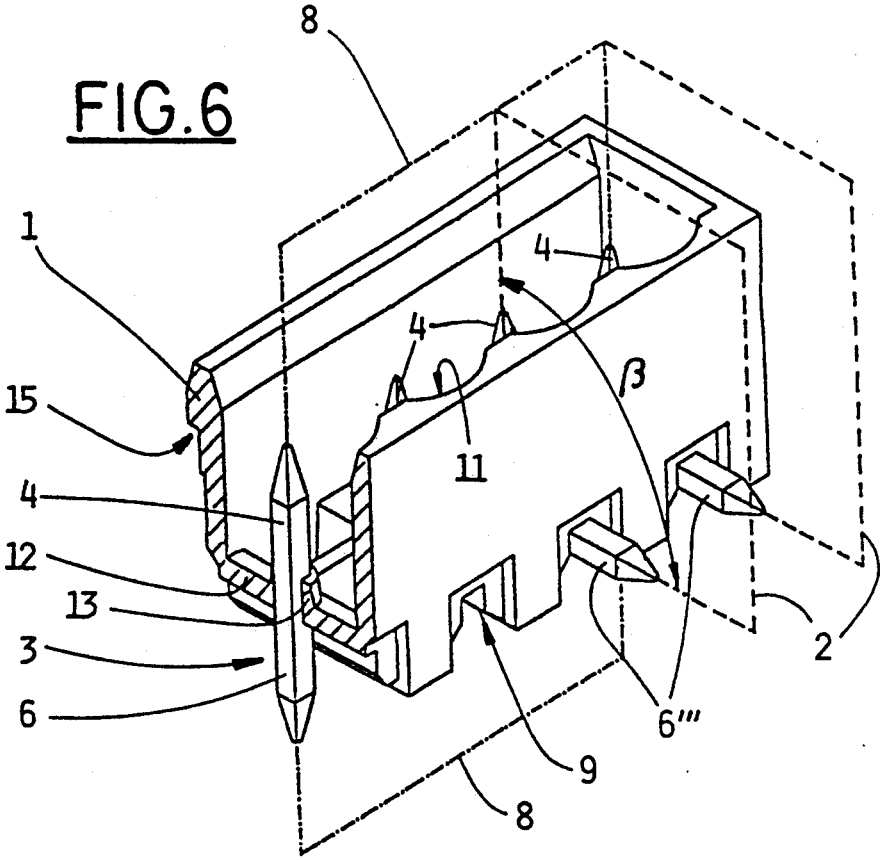
FIG. 6, a further embodiment of a plug-in connector of the invention.

FIG. 1 shows a preferred embodiment of a plug-in connector. It is composed of a plastic insulating strip 1 having a U-shaped cross-sectional profile and several four-sided contact pins 3. The contact pins 3 are fastened in a force-locking manner in the middle of the bottom wall 12 in a row of projections 13 in the bottom wall 12 oriented toward the interior of the U-shaped profile and extending in the longitudinal direction and are arranged in mutually parallel planes 2. The plug-in arms 4 extending into the interior of the U-shaped profile and serving for the connection with a female connector 5 all lie in the plane 8 of the plug-in arms that divides the insulating strip 1 longitudinally into two essentially symmetrical halves.

The printed circuit board arms 6', 6'', 6''' which are plugged into a printed circuit board and are disposed on the side of the bottom wall 12 facing away from the plug-in arms 4 are bent out of the plane 8 of the plug-in arms at a right angle a, a', some toward the one side and some toward the other side, and project from the side walls 10, 10' of the insulating strip 1. Until they exit from the side faces 10, 10' of 1, the root regions of the printed circuit board arms 6', 6'', 6''' lie in grooves 9 extending transversely to the longitudinal direction and taking up almost the entire width of the insulating strip 1.

The plug-in connector is connected with the printed circuit boards in that the printed circuit board arms 6', 6'', 6''' are inserted into corresponding bores 14 in the printed circuit boards 7, 7' and are soldered in on the side of the circuit board 7, 7' facing away from the plug-in connector (FIG. 4). In the above-described embodiment of the plug-in connector, the two printed circuit boards 7, 7' lie parallel to one another and parallel to the side walls 10, 10' of the insulating strip 1, i.e. parallel to the plug-in arms 4. The plugging in is achieved in that a female connector 5, for example, in the form of a socket strip, is plugged onto the plug-in arms 4. As an insertion aid and to ensure correct insertion of the plug, trough-shaped recesses 11 are provided on the interior of the side wall 10' of the insulating strip 1 to extend in the plug-in direction; corresponding beads (not shown) on the female connector 5 engage into these recesses 11. The side wall 10 disposed opposite the recesses 11 is provided on its exterior with a projection 15 extending over the entire length of the insulating strip 1 against which engages an arresting device 16 on the female connector 5 so as to secure the female connector 5 against inadvertent removal.

Figure 7:
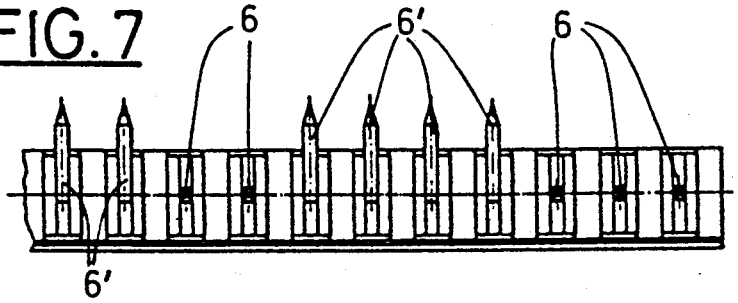
FIG. 7, a top view of the underside of the plug-in connector of FIG. 6.
Figure 8:
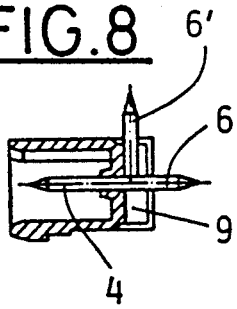
FIG. 8, a sectional view of the plug-in connector of FIG. 6.
Figure 9:
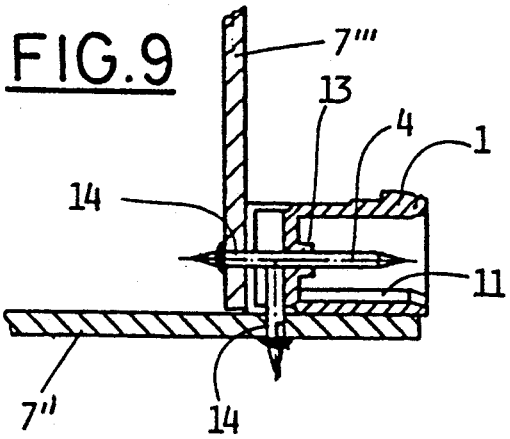
FIG. 9, a sectional view of the plug-in connector of FIG. 6 connected with two printed circuit boards.
Figure 10:
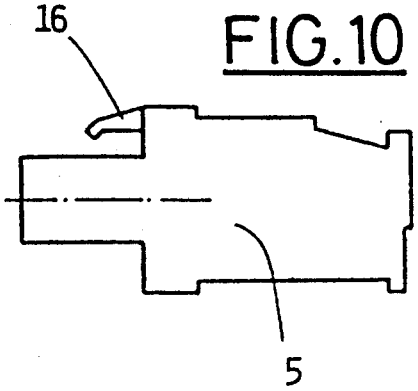
FIG. 10, a schematic drawing of a female connector.

FIGS. 6 to 9 show a further embodiment of the plug-in connector according to the invention. In this embodiment, part 6 of the printed circuit board arms, extends as a linear extension of the plug-in arms 4' in the plane 8 of the plug-in arms and another part (6''') is bent at a right angle $\beta$ out of the plane 8 of the plug-in arms. With such a plug-in connector, it is possible to connect a printed circuit board 7'' extending parallel to the plane 8 of the plug-in arms and another printed circuit board 7''' extending at a right angle thereto.

I claim:

1. A multi-pole plug-in connector for connecting a female connector of an electrical cable to first and second printed circuit boards, said multi-pole plug-in connector comprising:

an elongated insulating strip having a substantially U-shaped cross-section with a bottom wall and a pair of parallel side walls extending from said bottom wall;

a plurality of spaced parallel grooves defined in an outer surface of said bottom wall, with said grooves extending to respective outer surfaces of both of said side walls and transverse to the longitudinal direction of said strip; and a plurality of contact pins attached to said insulating strip, disposed in substantially mutually parallel planes, and extending through said bottom wall and through respective ones of said grooves, and with each of said plurality of contact pins including a plug-in arm disposed between said side walls and a printed circuit board arm extending from said outer surface of said bottom wall; and wherein:

(1) said plug-in arms are located in a common plane substantially perpendicular to said mutually parallel planes, are disposed between said side walls in a single row, extend in a first direction, and are connectable to female connectors;

(2) a first plurality of said printed circuit board arms extend in a second direction transverse to said common plane and outwardly of the respective said outer surface of a first of said pair of side walls, are disposed in respective ones of said grooves, and are electrically and mechanically connectable with a first printed circuit board; and (3) a second plurality of said printed circuit board arms extend from said bottom wall in a third direction and are electrically and mechanically connectable with a second printed circuit board, with said third direction being at an angle to said second direction.

2. A plug-in connector according to claim 1, wherein said common plane of the plug-in arms divides said U-shaped cross-section into two substantially symmetrical halves.

3. A plug-in connector according to claim 1, wherein said second direction extends substantially opposite to said third direction; and wherein said second plurality of printed circuit board arms extend outwardly of the respective said outer surface of a second of said pair of side walls and are disposed in respective ones of said grooves.

4. A plug-in connector according to claim 3, wherein said second and third directions each extends substantially perpendicular to said first direction.

5. A plug-in connector according to claim 1, wherein said second direction is substantially opposite and parallel to said first direction.

6. A plug-in connector according to claim 5, wherein said third direction is substantially perpendicular to said first and second directions.

7. A plug-in connector according to claim 7, further comprising groove-shaped recesses on an inner surface of one of said pair of side walls for guiding insertion of a female connector on said plurality of plug-in arms.

8. A plug-in connector as defined in claim 7 further comprising a longitudinally extending projection on said outer surface of the other of said pair of side walls for engaging a mating projection on a female connector connected to said plug-in arms to prevent inadvertent removal of the female connector.

9. A plug-in connector according to claim 7, wherein each of said contact pins is disposed in a force locking manner in a respective bore extending through said bottom wall.

10. A plug-in connector according to claim 9, wherein each said contact pins has a substantially square cross-section.

* * * * *